US008206187B2

(12) United States Patent
Nakamura et al.

(10) Patent No.: US 8,206,187 B2
(45) Date of Patent: Jun. 26, 2012

(54) FEMALE TERMINAL FITTING

(75) Inventors: Keiichi Nakamura, Yokkaichi (JP); Ryotaro Ishikawa, Yokkaichi (JP); Song Zheng, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/347,939

(22) Filed: Jan. 11, 2012

(65) Prior Publication Data

US 2012/0108114 A1 May 3, 2012

Related U.S. Application Data

(62) Division of application No. 12/954,178, filed on Nov. 24, 2010.

(30) Foreign Application Priority Data

Dec. 2, 2009 (JP) ..... 2009-274696

(51) Int. Cl.
*H01R 11/22* (2006.01)

(52) U.S. Cl. ..... 439/852

(58) Field of Classification Search ..... 439/852, 439/849–851, 854, 862
See application file for complete search history.

(56) References Cited

U.S. PATENT DOCUMENTS

| | | | | |
|---|---|---|---|---|
| 5,443,592 | A | 8/1995 | Ittah et al. | |
| 5,591,054 | A | 1/1997 | Okada et al. | |
| 5,593,328 | A | 1/1997 | Okada et al. | |
| 5,681,192 | A | 10/1997 | Kobayashi et al. | |
| 5,707,259 | A | 1/1998 | Ishizuka et al. | |
| 6,066,009 | A | 5/2000 | Yamamoto | |
| 6,095,873 | A * | 8/2000 | Muramatsu et al. | 439/852 |
| 6,293,832 | B1 * | 9/2001 | Yamamoto | 439/850 |
| 6,544,080 | B1 | 4/2003 | Yamamoto | |
| 7,094,115 | B2 | 8/2006 | Noro et al. | |
| 7,147,522 | B2 | 12/2006 | Kobayashi et al. | |
| 7,544,106 | B2 * | 6/2009 | Muneyasu | 439/852 |
| 7,572,142 | B2 * | 8/2009 | Katsuma | 439/489 |
| 2002/0025733 | A1 | 2/2002 | Saito | |
| 2006/0172618 | A1 | 8/2006 | Yamashita et al. | |
| 2007/0021013 | A1 | 1/2007 | Myer et al. | |
| 2007/0218763 | A1 | 9/2007 | Rehbein et al. | |
| 2008/0102717 | A1 | 5/2008 | Muneyasu | |

FOREIGN PATENT DOCUMENTS

| | | |
|---|---|---|
| JP | 2003-346958 | 12/2003 |

* cited by examiner

*Primary Examiner* — Tulsidas C Patel
*Assistant Examiner* — Phuongchi Nguyen
(74) *Attorney, Agent, or Firm* — Gerald E. Hespos; Michael J. Porco

(57) ABSTRACT

A tab (51) of a male terminal (50) is inserted into a main portion (11) of a female terminal (10). The tab (51) contacts a contact portion (16) of a resilient contact piece (15) to connect the female and male terminals (10, 50) electrically. A guiding portion (18) is formed on an inner surface of the main portion (11) for guiding the tab (51) inserted into the main portion (11) to a position where the tab (51) contacts the contact portion (16). The guiding portion (18) extends from a position before a contact position of the tab (51) with the contact portion (16) to the contact position while being inclined with respect to an inserting direction of the tab (51).

19 Claims, 9 Drawing Sheets

FEMALE TERMINAL FITTING

CROSS REFERENCE TO RELATED APPLICATION

This application is a divisional of U.S. patent application Ser. No. 12/954,178 filed Nov. 24, 2010.

BACKGROUND OF THE INVENTION

1. Field of the Invention

The invention relates to a female terminal fitting.

2. Description of the Related Art

Japanese Unexamined Patent Publication No. 2003-346958 discloses a conventional terminal fitting that has a female terminal with a rectangular tubular main portion and a male terminal with a tab. A resiliently deformable contact piece is formed in the main portion and a contact portion projects from the resilient contact piece. The tab can be inserted into the main portion and is held tightly between the contact portion of the resilient contact piece and an inner surface of the main portion. Thus, the male and female terminals are connected electrically.

Insertion resistance on the tab is established at once as soon as the tab contacts the contact portion of the above-described female terminal. Thus, operational efficiency may be deteriorated during the connection process.

The invention was developed in view of the above situation and an object thereof is to improve operability at the time of terminal connection.

SUMMARY OF THE INVENTION

The invention relates to a terminal fitting that comprises a female terminal with a substantially tubular main portion, and a male terminal with a tab that can be inserted into the main portion. A resiliently deformable resilient contact piece is formed in the main portion and has a contact portion that can contact the tab to connect the male and female terminals electrically. A guide is formed on at least one of an inner surface of the main portion and an outer surface of the tab for guiding the tab to a position in the main portion where the tab contacts the contact portion. The guide is inclined with respect to an inserting direction of the tab and extends from a position before a contact position of the tab with the contact portion at least to the contact position.

The guide guides the tab to the contact position with the contact portion. Thus, there is no likelihood that the tab will suddenly contact the contact portion to increase insertion resistance at once. Therefore, operational efficiency is improved while connecting the male and female terminals.

A receiving portion preferably projects from the inner surface of the main portion for tightly holding the tab between the contact portion and the receiving portion.

The guide preferably is formed on an inner surface of the receiving portion. Thus, the receiving portion functions to hold the tab between the resilient contact piece and the receiving portion and also functions to guide the tab. As a result, the construction of the main portion can be simplified.

The guide preferably is formed by cutting a part of one wall of the main portion and bending the cut part toward the contact portion. Thus, a degree of freedom in the form of the guide is increased as compared with the case where the guide is formed by hammering the one wall of the main portion to project toward the contact.

The guide preferably is formed on the outer surface of the tab. Thus, the guide can be deleted from the inner surface of the main portion, thereby simplifying the construction of the female terminal.

The guide preferably is formed so that the guide and both an inner surface of the receiving portion and the outer surface of the tab slide on each other. Thus, a contact load accompanying the contact of the tab and the contact portion can be increased by a smaller degree so that operational efficiency is improved further.

The contact portion preferably is arranged to face an intermediate position of the guide.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
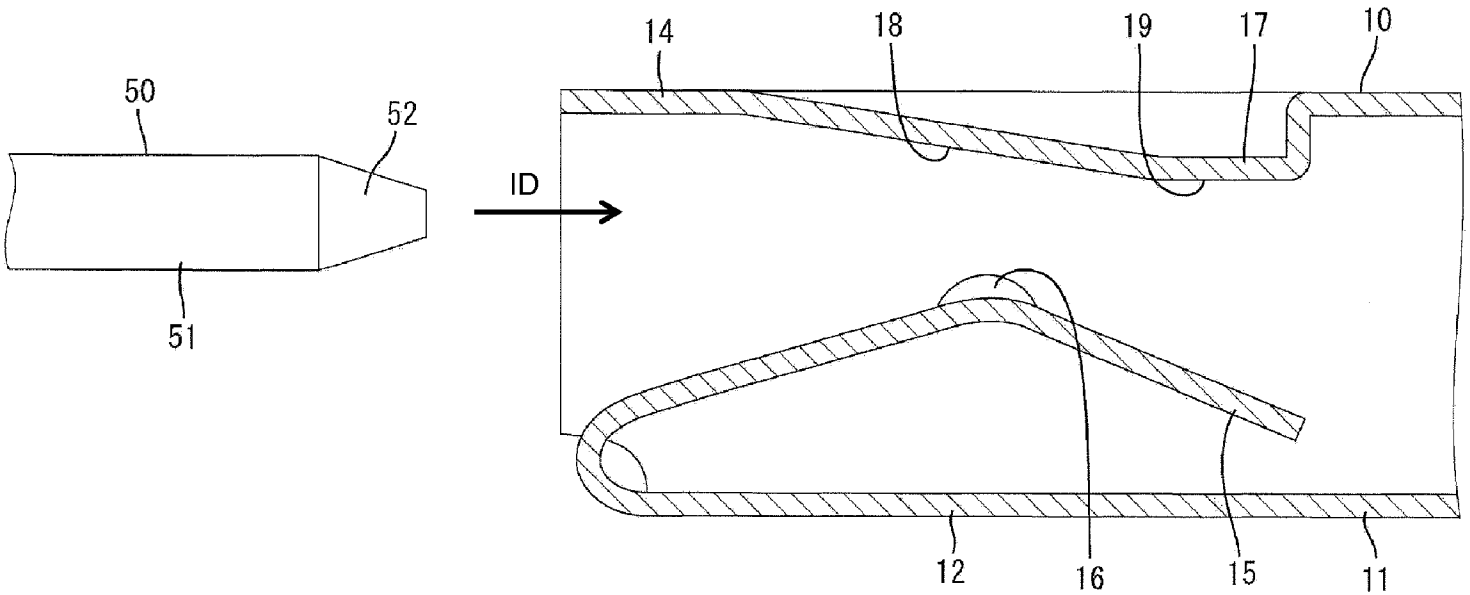
FIG. 1 is a section showing a state before a tab is inserted into a main portion in a terminal fitting according to a first embodiment of the invention.

A terminal fitting according to a first embodiment of the invention includes female and male terminals identified respectively by the numerals 10 and 50 in FIGS. 1 to 4. The female and male terminals 10, 50 are connectable with each other and are formed by applying bending and the like to an electrically conductive metal plate.

The male terminal 50 includes a substantially flat tab 51 extending longitudinally in forward and backward directions. The outer surface of a leading end of the tab 51 is cut or hammered to form a tapered guiding surface 52.

The female terminal 10 has a tubular main portion 11 and a wire connection portion behind the main portion 11. The wire connection portion may be configured to be crimped into connection to an end portion of an unillustrated wire.

The main portion 11 is a substantially rectangular tube and includes a base plate 12 continuous with the wire connection portion. Two side plates 13 stand up from opposite widthwise sides of the base plate 12 and a ceiling plate 14 bridges the upper ends of the side plates 13. A resilient contact piece 15 is in the main portion 11 and is formed to have a substantially mountain shape by folding back a part projecting forward from the front end of the base plate 12. A top portion of the resilient contact piece 15 particularly is hammered to form a rounded or substantially semispherical contact portion 16 projecting upward or inward. The resilient contact piece 15 is resiliently deformable up and down in a direction intersecting a tab insertion direction ID about the part of the contact piece 15 that is continuous with the front end of the base plate 12.

The ceiling plate 14 has a receiving portion 17 at a position facing the resilient contact piece 15 in a resiliently deforming direction of the resilient contact piece 15. The receiving portion 17 is formed by hammering a widthwise intermediate part of the ceiling plate 14 to project in and to define a rib extending in forward and backward directions, and/or to define a trapezoidal cross section. An inner surface of the receiving portion 17 is substantially even and wide in its entirety. Further, the inner surface of the receiving portion 17 is formed with a guide 18 inclined to gradually approach the resilient contact piece 15 from its front end toward its back. A starting point of the inclination of the guide 18 is between the front end of the resilient contact piece 15 and the contact portion 16, and an end point of the inclination of the guide 18 is between the contact portion 16 and the rear end of the resilient contact piece 15. In other words, the contact portion 16 is arranged to substantially face an intermediate position of the guide 18. Thus, the guide 18 is formed with such a length range from a position before a contact position of the tab 51 with the contact portion 16 to the contact position.

A vertical distance between the end point of the inclination of the guide 18 and the top of the contact portion 16 when the resilient contact piece 15 is in its natural state is set to be smaller than the thickness of the tab 51. Further, the inner surface of the receiving portion 17 is formed with a substantially horizontal wide flat surface 19 from the end point of the inclination of the guide 18 to the rear end of the receiving portion 17.

Figure 2:
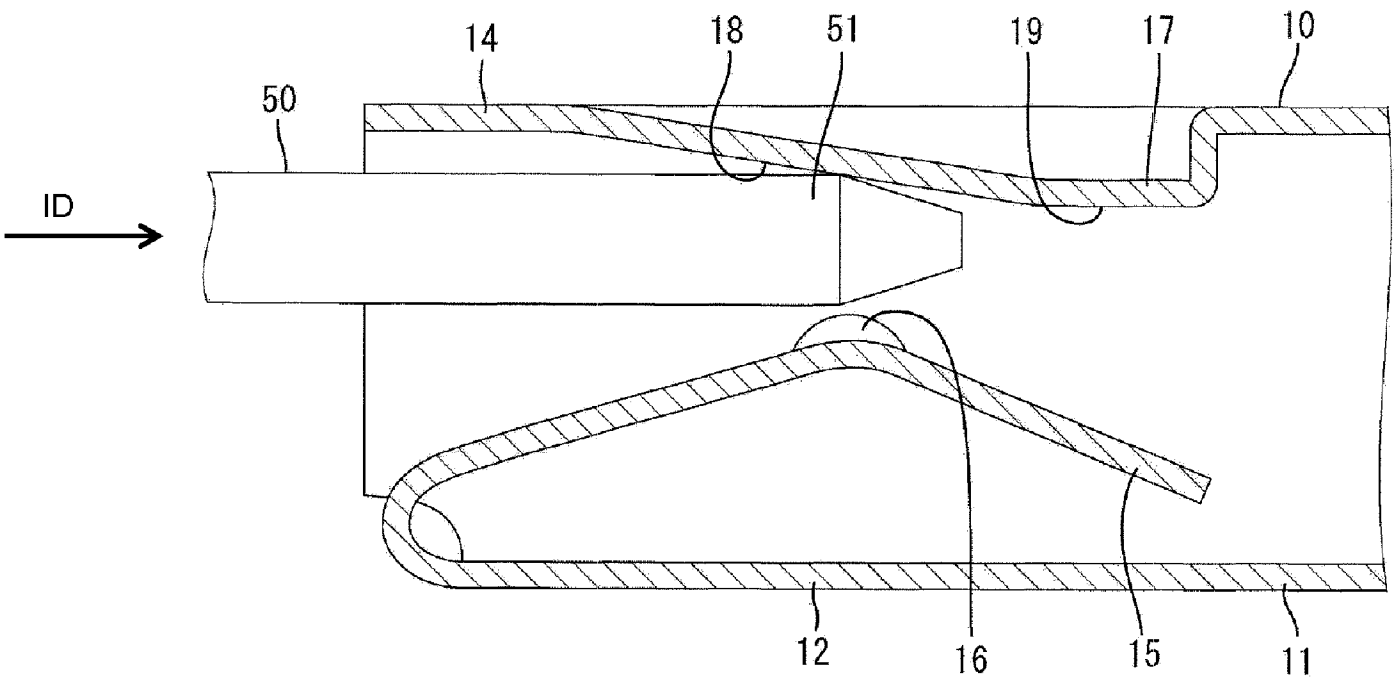
FIG. 2 is a section showing a state during insertion of the tab into the main portion.
Figure 3:
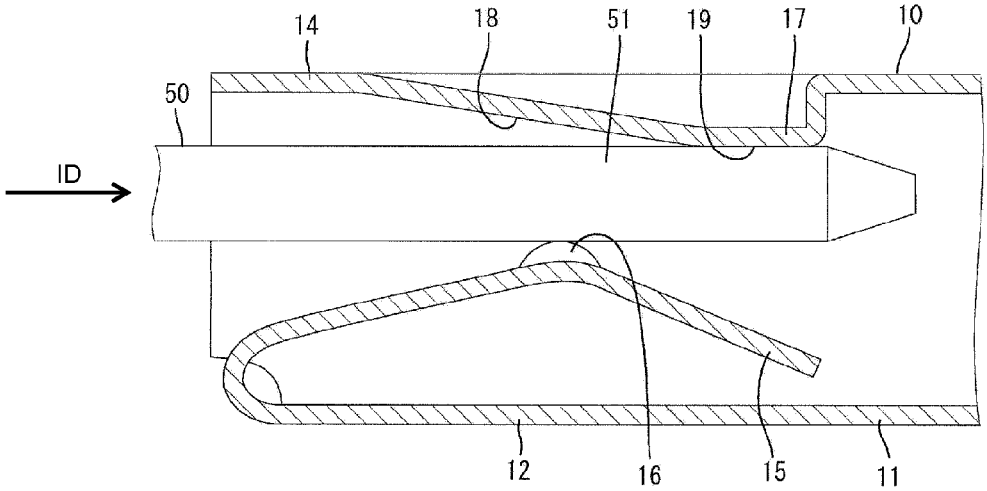
FIG. 3 is a section showing a state where the tab is inserted in the main portion.
Figure 4:
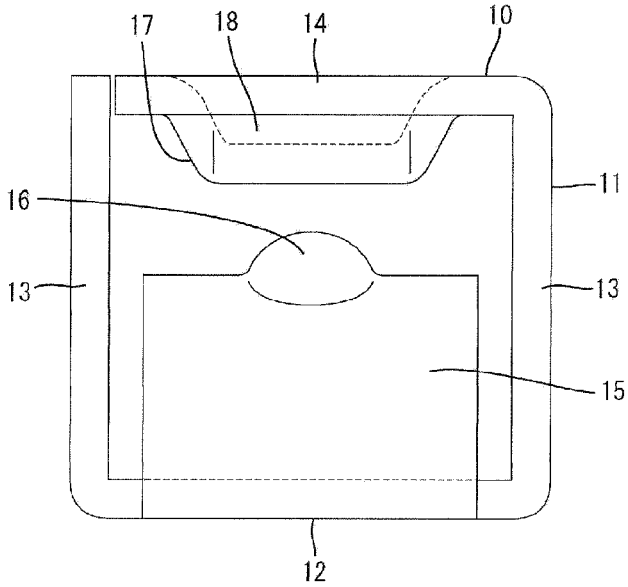
FIG. 4 is a front view of a female terminal.

The female and male terminals 10, 50 are accommodated in unillustrated female and male connector housings. Subsequently, the two housings are connected with each other. As a result, the tab 51 is inserted into the main portion 11 from the front and along the tab insertion direction ID. As shown in FIG. 2, the tab 51 contacts the guide 18 at a point in the insertion process before contacting the contact portion 16. Thus, the tab 51 slides on the guide 18 and is displaced gradually toward the contact portion 16 in a direction intersecting the tab insertion direction ID. Subsequently, the tab 51 contacts the contact portion 16 from above to resiliently deform the resilient contact piece 15 down while the tab 51 continues to slide on the guide 18. The tab 51 is held tightly between the receiving portion 17 and the resilient contact piece 15 when a leading end portion of the tab 51 reaches a position to be held in contact with the flat surface 19, as shown in FIG. 3. As a result, the female and male terminals 10, 50 are connected electrically.

As described above, the tab 51 is guided by the guide 18 and reaches the position to be held in contact with the contact portion 16 when inserted into the main portion 11. Thus, a sudden increase in insertion resistance is prevented as compared with the case where the tab 51 suddenly contacts the contact portion 16. In this case, the contact portion 16 faces the intermediate position of the guide 18. Thus, a guiding function by the guide 18 is displayed with the tab 51 held in contact with the contact portion 16. Therefore, insertion resistance accompanying the contact of the tab 51 and the contact portion 16 is increased gradually to improve operational efficiency when bringing the female and male terminals 10, 50 into contact.

The guide 18 is formed on the inner surface of the receiving portion 17 of the main portion 11. Thus, the receiving portion 17 functions to hold the tab 51 against the resilient contact piece 15 and also function to guide the tab 51. As a result, the construction of the main portion 11 can be simplified.

Figure 5:
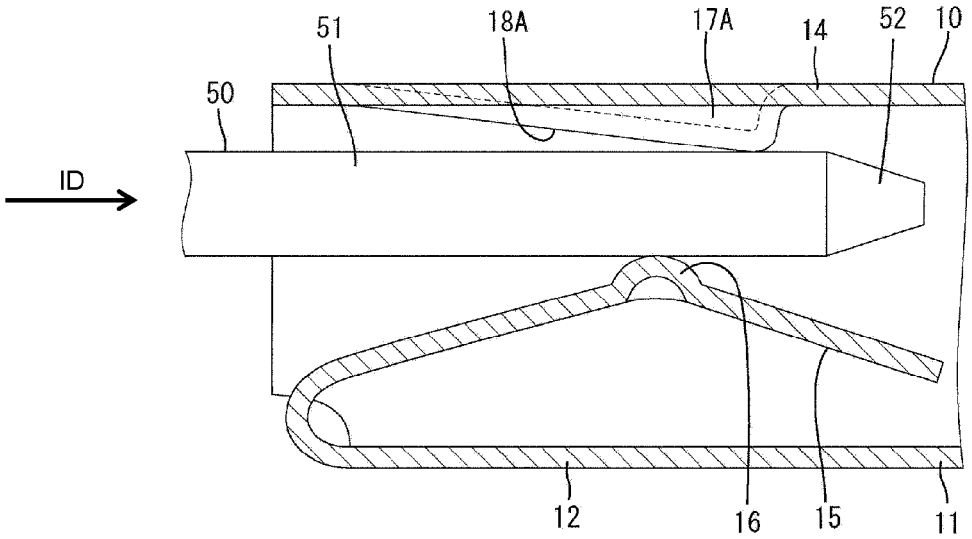
FIG. 5 is a section showing a state before a tab is inserted into a main portion in a terminal fitting according to a second embodiment.
Figure 6:
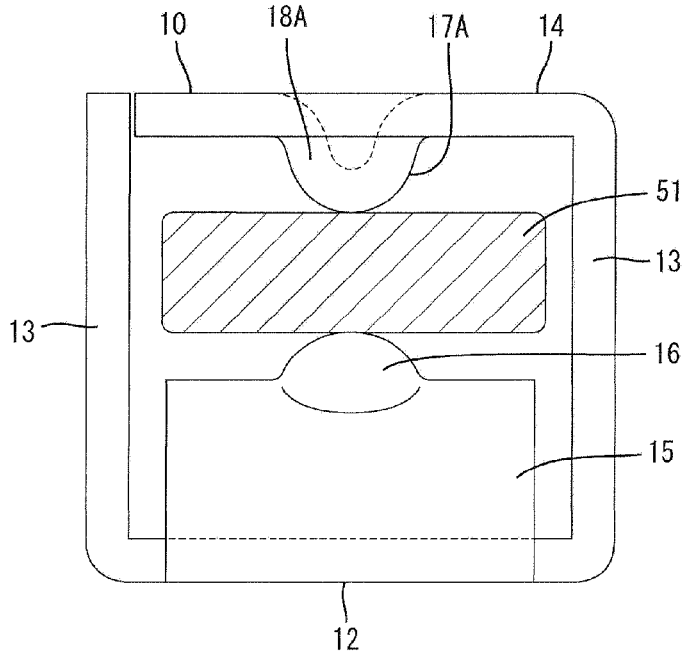
FIG. 6 is a front view showing the tab in the main portion.

FIGS. 5 and 6 show a second embodiment of the invention. In this female terminal 10, a widthwise intermediate part of a ceiling plate 14 of a main portion 11 is deformed to project down and in to form a narrow receiving portion 17A. The receiving portion 17A has a substantially V- or U-shaped cross section. A guide 18A is formed by a top of the receiving portion 17A and inclines to approach a resilient contact piece 15 gradually from the front toward the rear. The other construction is similar to or the same as the first embodiment.

The guide 18A guides a tab 51 inserted into the main portion 11 toward a contact position with a contact portion 16. The properly inserted tab 51 is held tightly between the guide 18A and the contact portion 16 while being supported at two points. In this way, both terminals 10, 50 are electrically connected. The second embodiment achieves the effects described above for the first embodiment.

Figure 7:
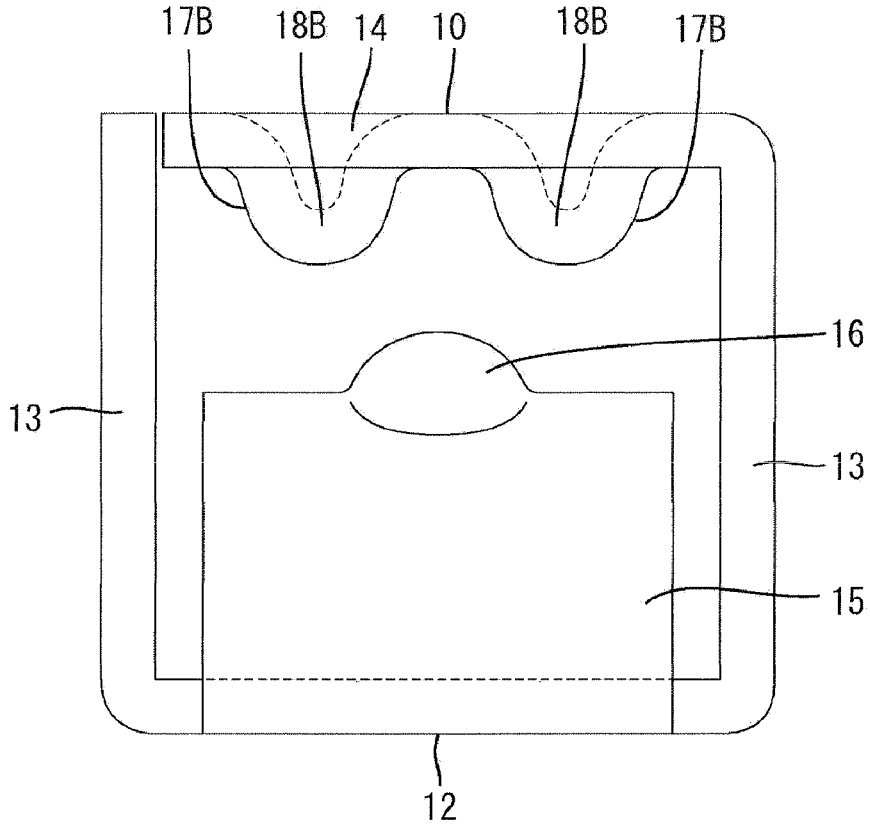
FIG. 7 is a front view of a female terminal in a terminal fitting according to a third embodiment.

FIG. 7 shows a third embodiment of the invention. In this female terminal 10, opposite widthwise sides of a ceiling plate 14 of a main portion 11 are deformed to project down and in to form two narrow receiving portions 17B. Each receiving portion 17B has a substantially U-shaped cross section and combined define a substantially W-shape. A guide 18B is defined at a top of each receiving portion 17B and inclines to approach a resilient contact piece 15 gradually from the front toward the rear. The other construction is substantially similar to or the same as the first embodiment.

The guides 18B guide the tab 51 to a contact position with a contact portion 16 in the process of inserting a tab 51 into the main portion 11. When being inserted to a proper depth in the main portion 11, the tab 51 is held tightly between the respective guides 18B and the contact portion 16 while supported at three points. In this way, both terminals 10, 50 are connected electrically. The second embodiment achieves the effects described above for the first embodiment.

Figure 8:
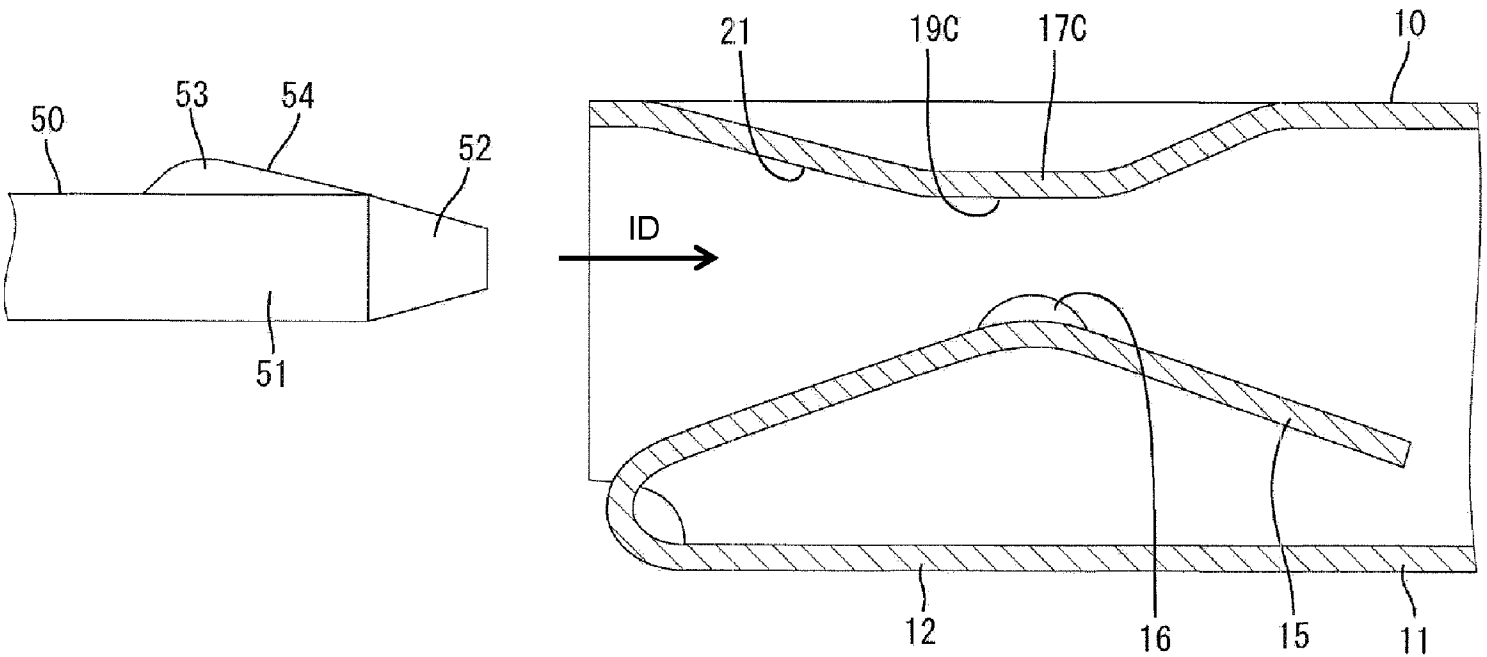
FIG. 8 is a section showing a state before a tab is inserted into a main portion in a terminal fitting according to a fourth embodiment.

FIG. 8 shows a fourth embodiment of the invention. A receiving portion 17C formed at a ceiling plate 14 of this female terminal 10 has no guiding portion. Rather, a substantially flat surface 19C is formed at a position of the receiving portion 17C facing a contact portion 16. An inclined portion 21 shorter than the guide 18 in forward and backward directions is formed at a front end of the receiving portion 17C. The other construction of the female terminal 10 is substantially similar to or the same as the first embodiment. On the other hand, an inclined projection 53 is formed on the outer surface near a leading end of a tab 51. The upper surface of the inclined projection 53 functions as a guide 54 and gradually inclines up and out from an end of a guiding surface 52 toward a back side. The guide 54 is even and wide and extends from a position before a contact position of the tab 51 with a contact portion 16 to the contact position with the contact portion 16.

The guide 54 slides on the inclined portion 21 of the receiving portion 17C in the process of inserting the tab 51 into a main portion 11 and the tab 51 displaces toward a resilient contact piece 15. The tab 51 contacts the contact portion 16 from above while the guide 18 is sliding on the inclined portion 21 of the receiving portion 17C and hence the tab 51 deforms the resilient contact piece 15 resiliently down in a direction intersecting the tab inserting direction ID. The properly inserted tab 51 is held tightly between the flat surface 19C of the receiving portion 17C and the contact portion 16 so that the terminals 10, 50 are connected electrically.

According to the fourth embodiment, the guide can be deleted from the female terminal 10 and the construction of the female terminal 10 can be simplified since the guide 54 is formed on the outer surface of the tab 51.

Figure 9:
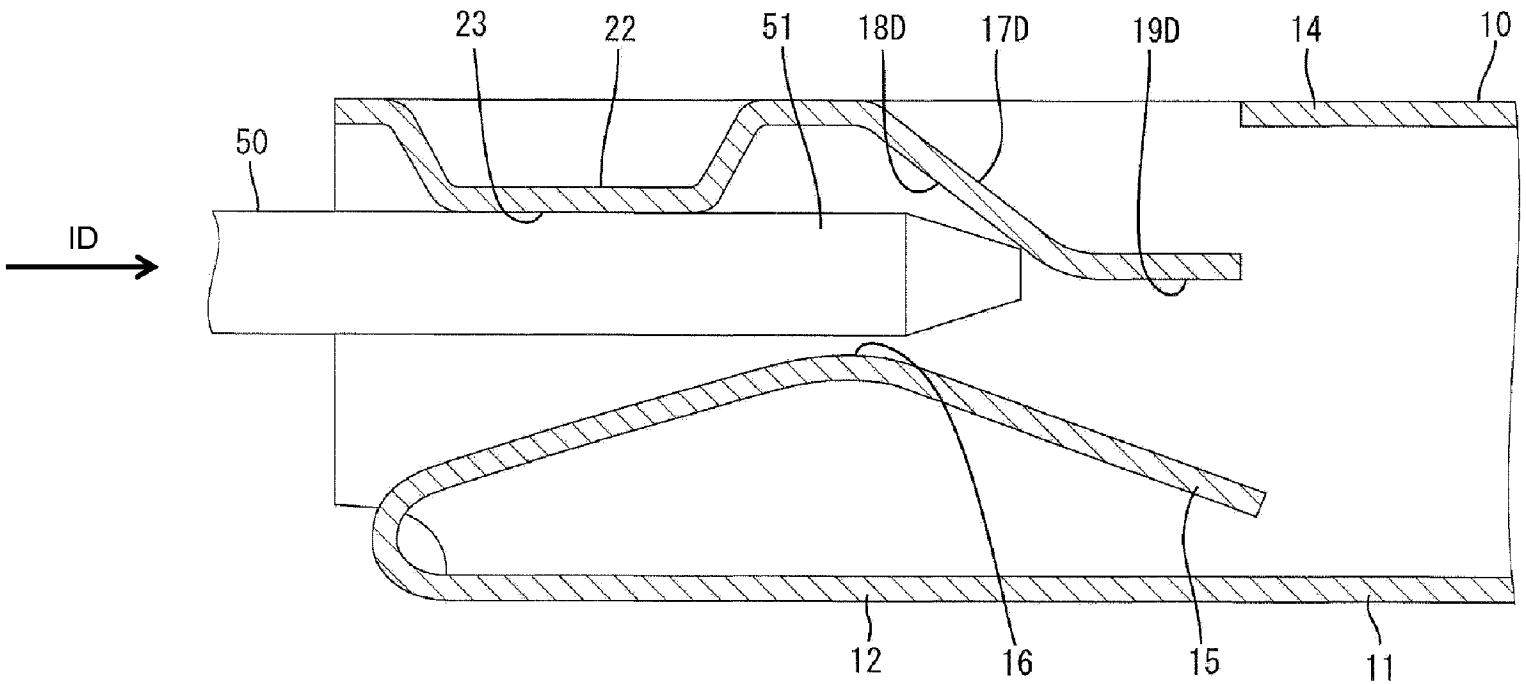
FIG. 9 is a section showing a state during insertion of a tab into a main portion in a terminal fitting according to a fifth embodiment.

FIG. 9 shows a fifth embodiment of the invention. In this female terminal 10, a part of a ceiling plate 14 is cut and bent into a main portion 11 to form a receiving portion 17D. An inner surface of the receiving portion 17D has a guide 18D that gradually inclines toward a resilient contact piece 15 from the front toward the rear and a substantially horizontal flat surface 19D extends from an end of the inclination of the guide 18D to the rear end of the receiving portion 17D. Further, a part of the ceiling plate 14 before the receiving portion 17 is deformed to project down and in to form a front receiving portion 22. A wide horizontal supporting surface 23 is formed on an inner surface of the front receiving portion 22. The other construction is similar to or the same as the first embodiment.

In the process of inserting the tab 51 into the main portion 11, the upper surface of the tab 51 slides on the supporting surface 23 of the front receiving portion 22 and the leading end of the tab 51 slides on the guide 18D. Thus, the tab 51 is displaced toward the contact portion 16. The resilient contact piece 15 is pushed resiliently down by the tab 51 while the leading end of the tab 51 slides on the guide 18D to increase insertion resistance gradually. The properly inserted tab 51 is held tightly between the flat surface 19D of the receiving portion 17D and the contact portion 16 so that both terminals 10, 50 are connected electrically.

The guide 18D of the fifth embodiment is formed on the inner surface of the receiving portion 17D by cutting part of the ceiling plate 14 of the main portion 11 and bending this cut part toward the contact portion 16. Thus, a degree of freedom in the form of the guide 18D can be increased as compared with the case where the guide is formed by hammering the ceiling plate 14 to project toward the contact portion 16.

Figure 10:
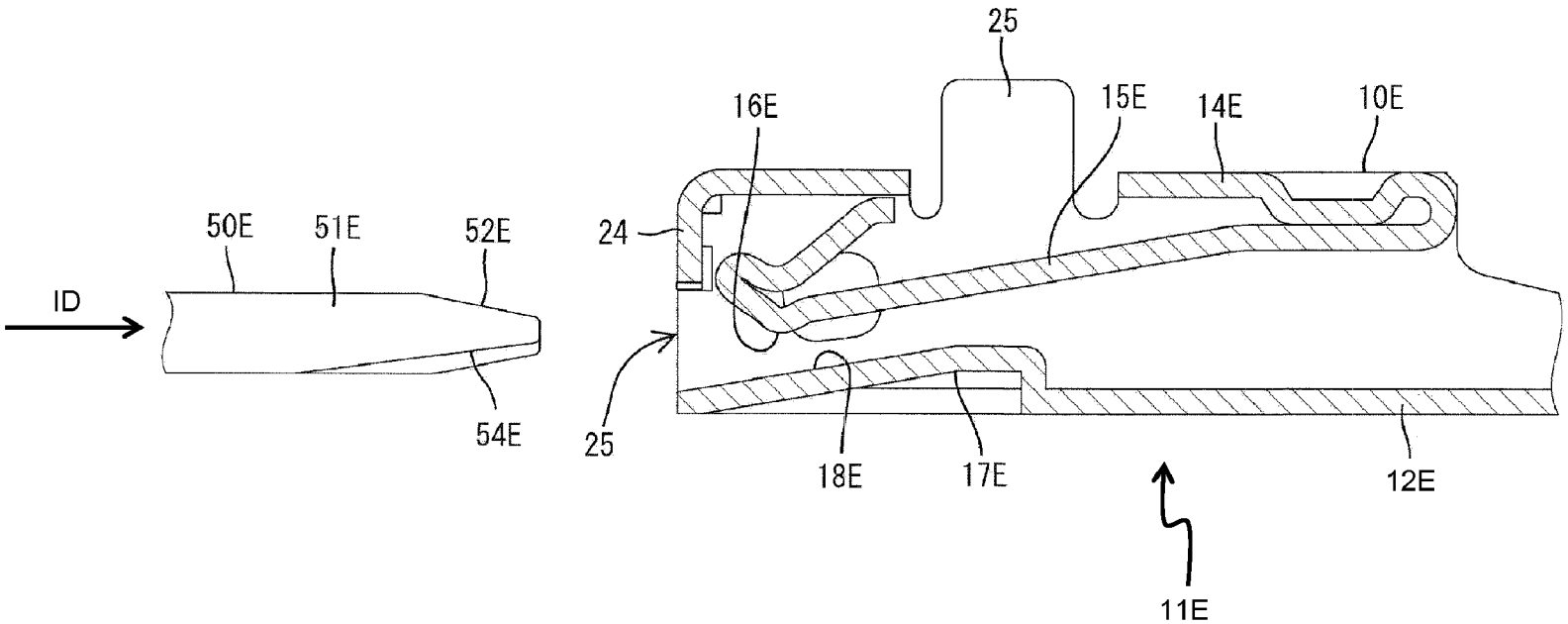
FIG. 10 is a section showing a state before a tab is inserted into a main portion in a terminal fitting according to a sixth embodiment.
Figure 11:
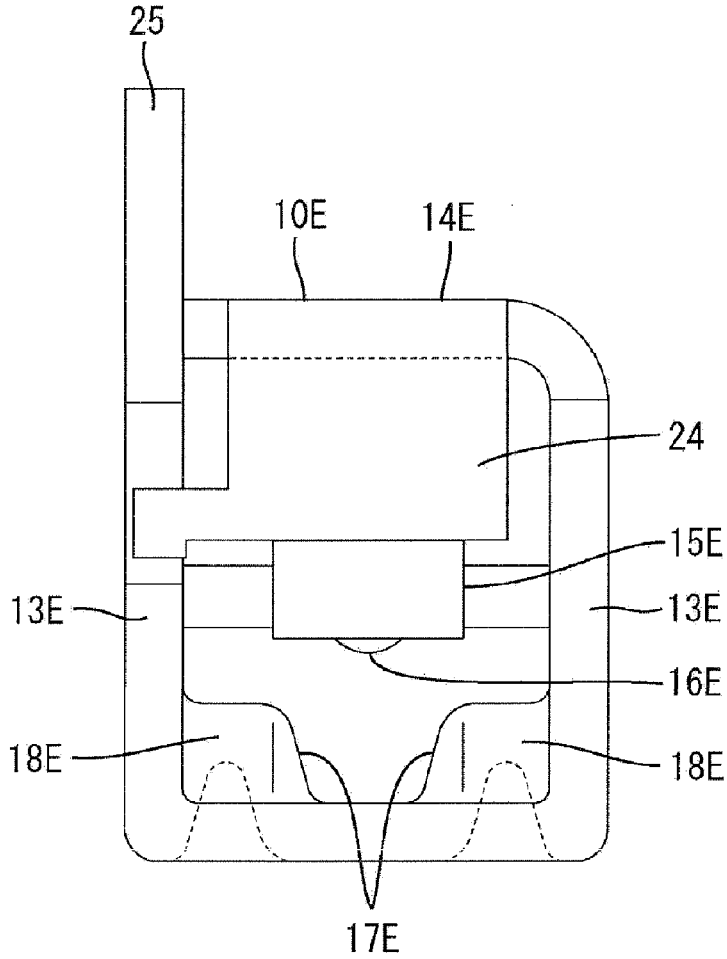
FIG. 11 is a front view of a female terminal.

FIGS. 10 and 11 show a sixth embodiment of the invention. A main portion 11E of a female terminal 10E has an upper part closed by a closing wall 24 hanging down and in from the front end of a ceiling plate 14E. An insertion opening 25 for a tab 51E is formed in a lower portion. At least one stabilizer 25 is formed to stand up from the upper end of a side plate 13E by cutting and bending a part of the ceiling plate 14E. A resiliently deformable resilient contact piece 15E is formed in the main portion 11E by folding a part extending back from the rear end of the ceiling plate 14E forward and closely bending the forward extending part at a position facing the insertion opening 25 so that the leading end thereof extends up to the inner surface of the ceiling plate 14E. A contact portion 16E projects at a bottom end of a closely bent part of the resilient contact piece 15E.

Substantially opposite widthwise ends of a bottom plate 12E are hammered or deformed to project up and in to form two receiving portions 17E. First guiding portions 18E are formed on inner surfaces of the respective receiving portions 17E and incline to approach the resilient contact piece 15E gradually from the front end of the bottom plate 12E toward a rear thereof. The receiving portions 17E are arranged at opposite sides of the contact portion 16E with respect to a width direction, as shown in FIG. 11.

On the other hand, the outer surface of the tab 51E is cut at substantially opposite widthwise sides thereof to form two second guides 54E gradually sloped down from the leading ends thereof toward rear. The respective second guides 54E are in a positional relationship to at least partly overlap a guiding surface 52E formed on the outer surface of a leading end of the tab 51E.

In the process of inserting the tab 51E into the main portion 11E, the respective second guides 54E slide on the corresponding first guides 18E to displace the tab 51E gradually toward the contact portion 16E. The tab 51E comes into contact with the contact portion 16E from below and causes the resilient contact piece 15E to deform resiliently up and out. Also during this time, a sliding contact state of the first and second guides 18E, 54 is maintained to increase insertion resistance of the tab 51E gradually. The properly inserted tab 51E is held tightly between the receiving portions 17E and the contact portion 16E so that the terminals 10E, 50E are connected electrically.

According to the sixth embodiment, a contact load accompanying the contact of the tab 51E and the contact portion 16E can be increased by a smaller degree so that operational efficiency is improved further.

The invention is not limited to the above described and illustrated embodiments. For example, the following embodiments are also included in the technical scope of the present invention.

The guide on the inner surface of the main portion may be at position different from the receiving portions.

It is sufficient for the guide formed on the inner surface of the main portion to extend from the position before the contact position of the tab with the contact portion to the contact position. The guide may be formed at the same position as the contact portion or at a position not overlapping the contact portion with respect to forward and backward directions.

What is claimed is:

1. A terminal fitting assembly, comprising:

a female terminal with a substantially tubular main portion having opposite first and second sides, at least one inwardly projecting receiving portion at the first side of the main portion and an inwardly projecting resiliently deformable contact piece at the second side of the main portion, a contact portion being formed on the contact piece; and a tab to be inserted into the main portion, the tab having a front end, opposite first and second surfaces extending rearward from the front end and facing the first and second sides of the main portion when the tab is inserted into the main portion, the first and second surfaces including first and second guiding surfaces tapered substantially symmetrically toward one another at the front end of the tab, at least one guide tapered out on the first surface of the tab rearward of and adjacent to the first guiding surface, the guide being disposed so that the receiving portion engages the guide before the second surface of the tab engages the contact portion so that engagement between the guide and the receiving portion urges the tab gradually toward the contact portion as the tab is inserted into the main portion for electrically connecting the tab and female terminal.

2. The terminal fitting assembly of claim 1, wherein the female terminal includes an open front end for receiving the tab and an outwardly sloped guide extending from the receiving portion toward the front end.

3. The terminal fitting assembly of claim 2, wherein the outwardly sloped guide is between the contact portion and the front end of the female terminal.

4. The terminal fitting assembly of claim 2, wherein the contact portion is between the outwardly sloped guide and the front end of the female terminal.

5. The terminal fitting assembly of claim 1, wherein the at least one guide comprises two laterally spaced guides on the first surface of the tab.

6. The terminal fitting assembly of claim 5, wherein the at least one inwardly projecting receiving portion at the first side of the main portion of the female terminal includes first and second laterally spaced receiving portions disposed to engage the two guides of the tab.

7. The terminal fitting assembly of claim 5, wherein the tab has a front end, the guides extending rearward from the front end.

8. The terminal fitting assembly of claim 7, wherein the first and second surfaces include first and second guiding surfaces tapered substantially toward one another at the front end of the tab, the first guiding surface being between the two guides.

9. The terminal fitting assembly of claim 8, wherein the guides extend more rearward than the first and second guiding surfaces and are tapered more gradually than the first and second guiding surfaces.

10. A terminal fitting assembly, comprising:

a female terminal with a substantially tubular main portion having opposite first and second sides, at least one inwardly projecting receiving portion at the first side of the main portion and an inwardly projecting resiliently deformable contact piece at the second side of the main portion, a contact portion being formed on the contact piece; and a tab to be inserted into the main portion for electrically connection with the female terminal, the tab having a front end and opposite first and second surfaces facing the first and second sides of the main portion when front end of the tab is inserted into the main portion, portions of the first and second surfaces of the tab adjacent the front end having tapers that taper away from one another at farther distances from the front end of the tab, the taper on the first surface including a guide extending farther from the front end than the taper on the second surface, the guide being disposed so that the receiving portion engage the guide and urges the second surface of the tab gradually toward the contact portion as the tab is inserted into the main portion.

11. The terminal fitting assembly of claim 10, wherein the tapers on the tab define first and second guiding surfaces tapered substantially symmetrically toward one another on the respective first and second surfaces of the tab, the guides being rearward of and adjacent to the first guiding surface.

12. The terminal fitting assembly of claim 10, wherein the female terminal includes an open front end for receiving the tab and an outwardly sloped guide extending from the receiving portion toward the front end.

13. The terminal fitting assembly of claim 12, wherein the outwardly sloped guide is between the contact portion and the front end of the female terminal.

14. The terminal fitting assembly of claim 12, wherein the contact portion is between the outwardly sloped guide and the front end of the female terminal.

15. The terminal fitting assembly of claim 10, wherein the at least one guide comprises two laterally spaced guides on the first surface of the tab.

16. The terminal fitting assembly of claim 15, wherein the two guides extend rearward from the front end of the tab.

17. The terminal fitting assembly of claim 16, wherein the at least one inwardly projecting receiving portion at the first side of the main portion of the female terminal includes first and second laterally spaced receiving portions disposed to engage the two guides of the tab.

18. The terminal fitting assembly of claim 16, wherein the tapers on the first and second surfaces include first and second guiding surfaces tapered substantially toward one another at the front end of the tab, the first guiding surface being between the two guides.

19. The terminal fitting assembly of claim 18, wherein the guides extend more rearward than the first and second guiding surfaces and are tapered more gradually than the first and second guiding surfaces.

* * * * *